US005385523A

United States Patent [19]

Forrest

[11] Patent Number: 5,385,523

[45] Date of Patent: Jan. 31, 1995

[54] DUAL MOTION BLOCKING SLED

[76] Inventor: Charles P. Forrest, 1306 St. Stephens Rd., Mobile, Ala. 36603

[21] Appl. No.: 168,203

[22] Filed: Dec. 17, 1993

[51] Int. Cl.[6] ..... A63B 67/00

[52] U.S. Cl. ..... 482/83; 273/55 R; 273/55 A; 482/90

[58] Field of Search ..... 273/55 A, 55 R; 482/142, 83-90

[56] References Cited

U.S. PATENT DOCUMENTS

| | | | |
|---|---|---|---|
| 2,820,365 | 1/1958 | Detzel | 273/55 R |
| 3,044,776 | 7/1962 | Weidmaier et al. | 273/55 R |
| 3,216,724 | 11/1965 | Williams | 273/55 R |
| 3,329,428 | 7/1967 | Moran | 273/55 R |
| 3,514,105 | 5/1970 | Pillard | 273/55 R |
| 3,684,283 | 8/1972 | Forrest | 273/55 R |
| 3,827,690 | 8/1974 | Rogers | 273/55 R |
| 3,897,060 | 7/1975 | Jennings | 273/55 R |
| 4,067,571 | 1/1978 | Rogers | 273/55 R |
| 4,087,089 | 5/1978 | Forrest | 273/55 R |
| 5,013,039 | 5/1991 | Cole | 273/55 R |

FOREIGN PATENT DOCUMENTS

| | | | |
|---|---|---|---|
| 2337563 | 9/1977 | France | 273/55 R |

*Primary Examiner*—Richard J. Apley
*Assistant Examiner*—Jerome Donnelly
*Attorney, Agent, or Firm*—H. Jay Spiegel

[57] ABSTRACT

A blocking sled has a pad mounted on a runner body via a mechanism allowing reciprocation and lifting of the pad. The user hits the pad and can push the pad inwardly while it pivots upwardly simultaneously. When the furthest extent of motion is achieved, further movement by the user will result in pushing of the entire sled assembly itself.

9 Claims, 4 Drawing Sheets

DUAL MOTION BLOCKING SLED

BACKGROUND OF THE INVENTION

The present invention relates to a dual motion blocking sled. In the prior art, blocking sleds are known. However, Applicant is unaware of any prior art teaching all of the aspects of the present invention.

The following prior art is known to Applicant:

U.S. Pat. No. 3,804,410 to Gilman discloses a football training sled having a plurality of upstanding spring members fastened to a sled frame having a plurality of cross members. The present invention differs from the teachings of Gilman for many reasons, but particularly as including only a single cross member to hold a multiplicity of blocking elements together to move in unison.

U.S. Pat. No. 3,827,690 to Rogers discloses a blocking sled having a pad D mounted on a post 56 which is reciprocably received within an elongated receptacle 52. The user may engage the pad D and may reciprocate the pad D with respect to the frame of the device by reciprocating the post 56 within the receptacle 52. If desired, the user may lift the entire assembly with the runners thereof partially leaving the ground, as illustrated in FIG. 1. The present invention differs from the teachings of Rogers as contemplating a blocking sled wherein reciprocatory and pivoting movements of a pad may be carried out by the user while the runners of the associated frame remain firmly on the ground.

U.S. Pat. No. 3,998,456 to Sherman discloses a football training device including a plurality of simulated helmets mounted on a frame in a reciprocatory manner and including the provision of spring biasing means and position adjustment. The present invention differs from the teachings of Sherman as contemplating a blocking sled wherein reciprocatory and pivoting movements of a pad may be concurrently carried out while the runners of the device remain firmly on the ground.

U.S. Pat. No. 4,067,571 to Rogers discloses a stance training apparatus including a pad D mounted on a post 14 reciprocably received within a receptacle 16 mounted on the frame of the device. The present invention differs from the teachings of Rogers as contemplating the combination of reciprocatory and pivoting movements while the runners remain firmly on the ground.

U.S. Pat. No. 4,087,089 to Forrest, Applicant herein, discloses a football lineman trainer including individual stations having pads which may be pivoted but not reciprocated with respect to the associated frame. The present invention differs from the teachings of Forrest as contemplating the combination of reciprocatory and pivoting movements while the runners of the device remain firmly on the ground.

U.S. Pat. No. 4,508,341 to Carrington discloses a pass-blocking sled having a pivotable arm designed to be engaged by a player in practicing pass-blocking techniques. The present invention differs from the teachings of Carrington as contemplating a combination of reciprocatory and pivoting movements with the pivoting movements including lifting movements which are nowhere taught or suggested by Carrington.

U.S. Pat. No. 5,013,039 to Cole discloses a sports training apparatus comprising a blocking sled having pads pivotally connected to a frame assembly. The present invention differs from the teachings of Cole as contemplating a pivoting movement which includes a lifting component combined with horizontal reciprocation. This combination of movements is nowhere taught or suggested by Cole.

As should be understood from the description of the above discussed prior art, Applicant is unaware of any prior art blocking sled which allows the user to closely simulate situations which will occur during an actual football game. In particular, when a blocker on the offensive line of a football team is blocking a defensive lineman or other defender, movements in several directions and planes occur simultaneously. It is rare that a defensive lineman charges an offensive lineman without moving vertically during horizontal movement. It is equally rare for a defensive lineman to merely lift upwardly on an offensive lineman without attempting to move beyond the offensive lineman and to a position in the backfield. As such, devices such as those described above are not suitable for training an offensive lineman to anticipate actual game conditions.

Thus, the Rogers patents only effectively teach resisting direct forward charge of a defensive player. The lift illustrated in FIG. 1 of U.S. Pat. No. 3,827,690 does not realistically portray actual game conditions because such movement would be resisted by the dead weight of the entire device which includes a plurality or multiplicity of individual pad units. Furthermore, Applicant's prior patent, while it effectively simulates a lifting motion on the part of a defensive player, fails to simulate simultaneous lifting and charging movements by a defensive player. As such, a need has developed for a blocking sled which allows closer simulation of actual game conditions. It is with this goal in mind that the present invention was developed.

SUMMARY OF THE INVENTION

The present invention relates to a dual motion blocking sled. The present invention includes the following interrelated objects, aspects and features:

(A) In a first aspect, the present invention may comprise a single individualized blocking sled or may comprise a multiplicity of individual blocking sleds tied together through an elongated bracket to form a device usable by a multiplicity of players simultaneously.

(B) Each individual one-man blocking sled, in accordance with the teachings of the present invention, includes a base having guide runners and a pad attached to the base through a mechanical linkage.

(C) The mechanical linkage includes a bracket fixed to the base and supporting two pivotable arms. The pivotable arms support a generally upstanding arm forming a portion of a T-shaped assembly with the upstanding arm forming the base of the "T".

(D) The "top" of the "T" comprises an elongated cross member having a receptacle containing a compression spring and receiving an elongated arm designed to engage the compression spring so that reciprocatory movements of the elongated arm are against a force resistance. The elongated arm has an end remote from the receptacle which carries a vertically adjustable bracket designed to releasably carry the pad.

(E) Through the use of the inventive mechanical linkage, when a player hits the pad, the elongated arm reciprocates with respect to the receptacle while at the same time lifting movements of the player are permitted through operation of the pivotable arms. Once the reciprocatory and pivoting movements are concurrently carried out, further force on the pad will result in sliding movements of the entire sled assembly over a ground surface without lifting of the sled assembly off the ground.

(F) If desired, a plurality or multiplicity of individual blocking sleds, such as described above, may be coupled together to form a device known in the art as a "seven man sled" or a device having lesser numbers of coupled sleds. In this regard, the present invention provides a distinct advantage as contemplating interconnection of adjacent sled assemblies through the use of only a single shallow profile bracket. In the prior art, plural elongated brackets are employed to tie together plural sled assemblies. Coaches often wish their players to run through a sled device between adjacent pads thereof. Where a plurality or multiplicity of elongated brackets are employed to tie together adjacent sled assemblies, the brackets can prove to be dangerous, causing injury to players as they try to step over successive brackets. The present invention only utilizes a single elongated bracket of shallow profile thereby best facilitating players running between adjacent pads and over a sled assembly. As such, it is a first object of the present invention to provide a dual motion blocking sled.

It is a further object of the present invention to provide such a device wherein each sled assembly permits reciprocatory and pivoting movements of a pad.

It is a still further object of the present invention to provide such a device wherein a plurality or multiplicity of sled assemblies may be coupled together through the use of a single shallow profile elongated bracket.

It is a still further object of the present invention to provide such a device including a pad mounting bracket assembly which allows vertical adjustment.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
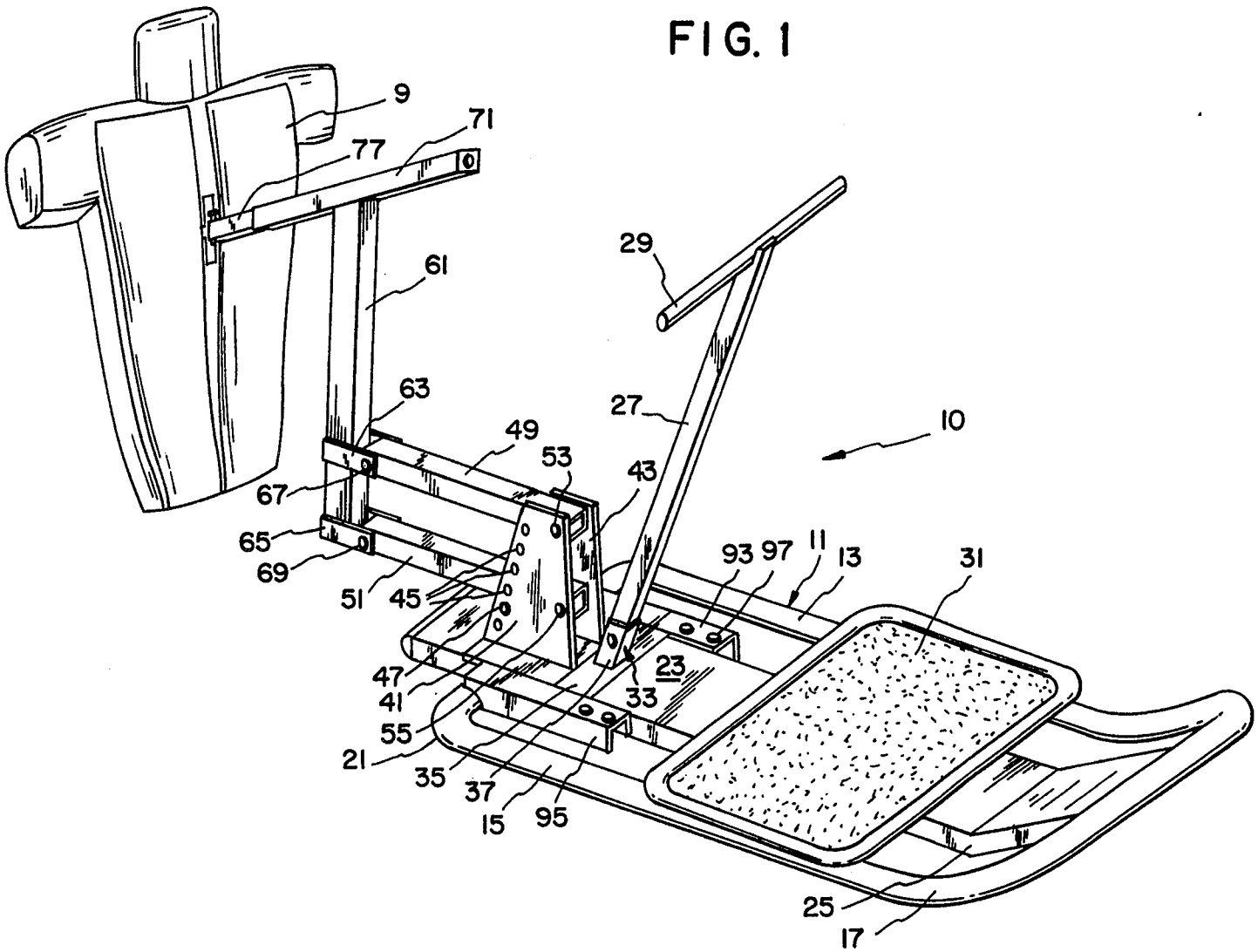
FIG. 1 shows a perspective view of a single sled assembly of the present invention.
Figure 2:
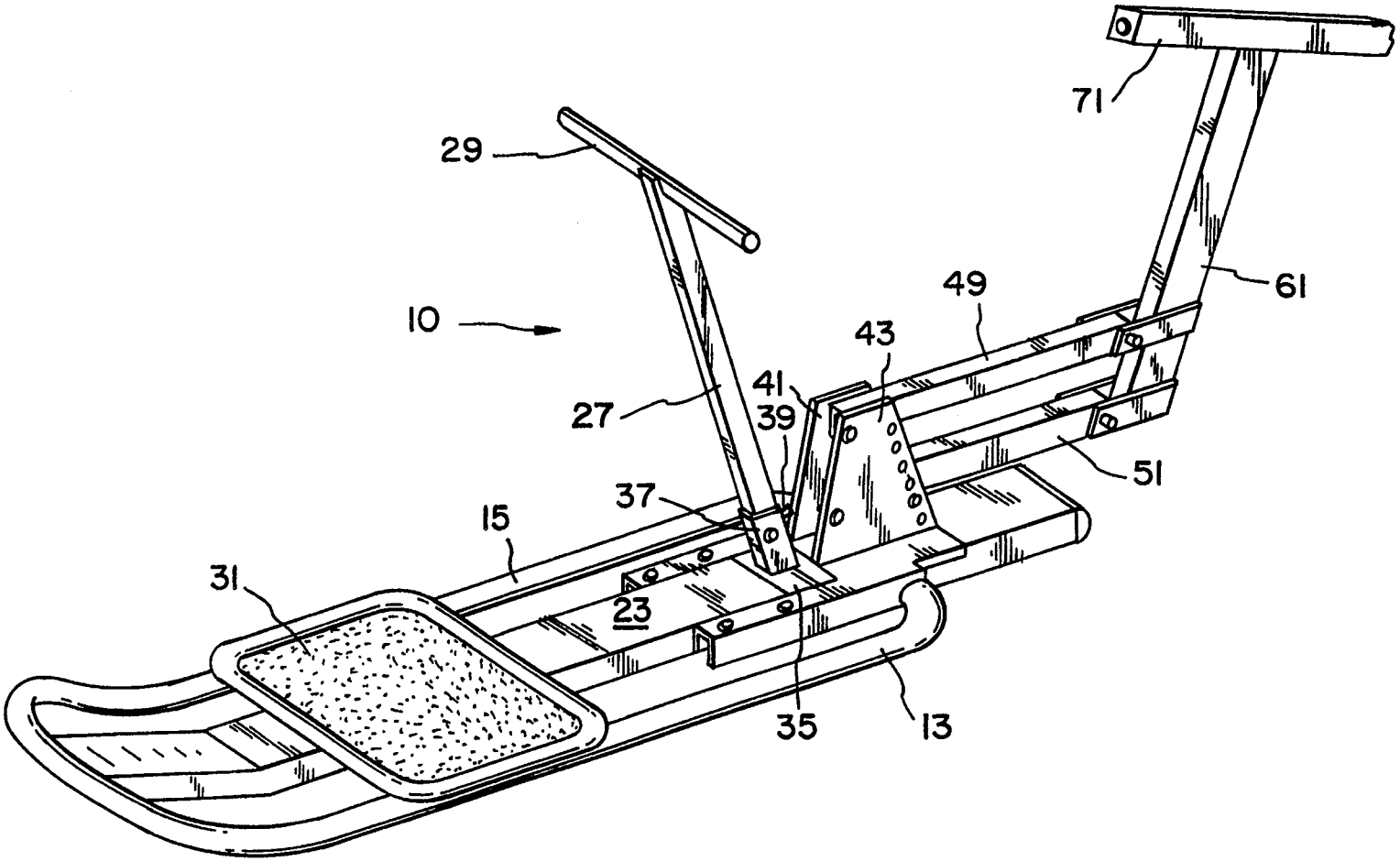
FIG. 2 shows a further perspective view from a different perspective from that which is depicted in FIG. 1.

With reference, first, to FIGS. 1 and 2, a preferred embodiment of the sled assembly forming a part of the present invention is generally designated by the reference numeral 10 and is seen to include a base 11 having runners 13 and 15 meeting at a distal end at an upturned end 17, and having curved proximal ends 19 and 21 as shown. A central wide but thin metal member 23 runs parallel to the runners 13 and 15 and provides strength to the base 11. As shown, in particular, in FIG. 1, the member 23 has a distal end 25 which is bent upwardly in the same manner as the end 17 connecting the runners 13 and 15.

With further reference to FIGS. 1 and 2, it is seen that the member 23 supports an upstanding stem 27 having a "T" end 29 remote from the base 11 and comprising a gripping handle. Furthermore, a platform 31 is provided connected between the runner 13, the member 23 and the runner 15. The platform 31 has a surface, as shown, which is roughened to provide firm support for a coach or trainer. The stem 27 is supported on a fitting 33 including a flat plate 35 suitably welded to the member 23 and an upstanding receptacle 37 of generally square cross-section to suitably couple with the square cross-section of the stem 27, as shown. A set screw 39 (FIG. 2) may be tightened to hold the stem 27 within the receptacle 37.

Proximal of the device 33 are two upstanding brackets 41 and 43 which lie in parallel planes. The brackets have a series of holes 45 which receive an elongated pin 47 for a purpose to be described in greater detail hereinafter.

As shown in particular in FIG. 1, pivotable arms 49 and 51 are pivotably mounted between the brackets 41 and 43 through the use of respective pins 53 and 55. The pins extend between aligned holes in the respective brackets 41 and 43 as shown. As should now be understood, the pin 47 may be inserted between aligned holes 45 in the brackets 41, 43 to define the degree of pivoting in a downward direction of the pivotable arms 49 and 51. In the position shown in FIG. 1, with the pin 47 extending between aligned holes 45, as shown, the pivotable arms 49, 51 are at their lowest position but may be pivoted upwardly from the position shown. If desired, a pin such as the pin 47 may be placed in one of the holes 45 above the lower arm 51 to limit the upward extent of pivoting thereof.

With further reference to FIGS. 1 and 2, it is seen that an upstanding arm 61 has brackets 63 and 65 to which are pivotably attached the respective pivotable arms 49 and 51 by virtue of the respective pivot pins 67 and 69, as shown. Thus, the arms 49 and 51 are constrained to pivot in parallel relation to one another throughout their respective ranges of motion. The brackets 41, 43, at least one of the arms 49, 51, with the corresponding pin 53 or 55, the corresponding one of the brackets 63, 65 and the pins 67 or 69 comprise first attachment means.

Figure 4:
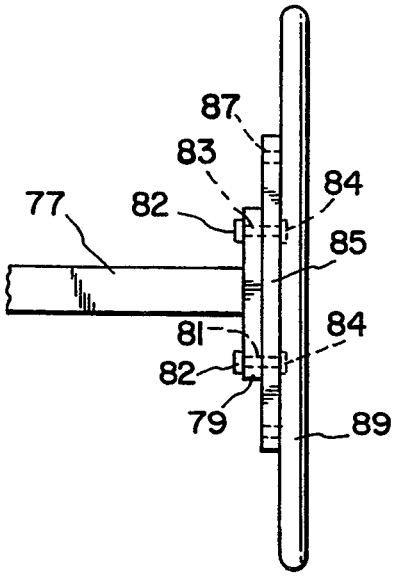
FIG. 4 shows a side view of the bracket assembly illustrated in FIG. 3 showing interconnection with an elongated arm forming a part of the present invention.
Figure 3:
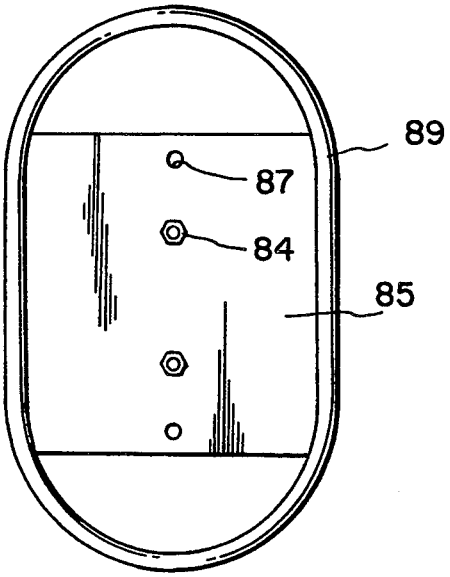
FIG. 3 shows a front view of a bracket assembly forming a part of the present invention.
Figure 5:
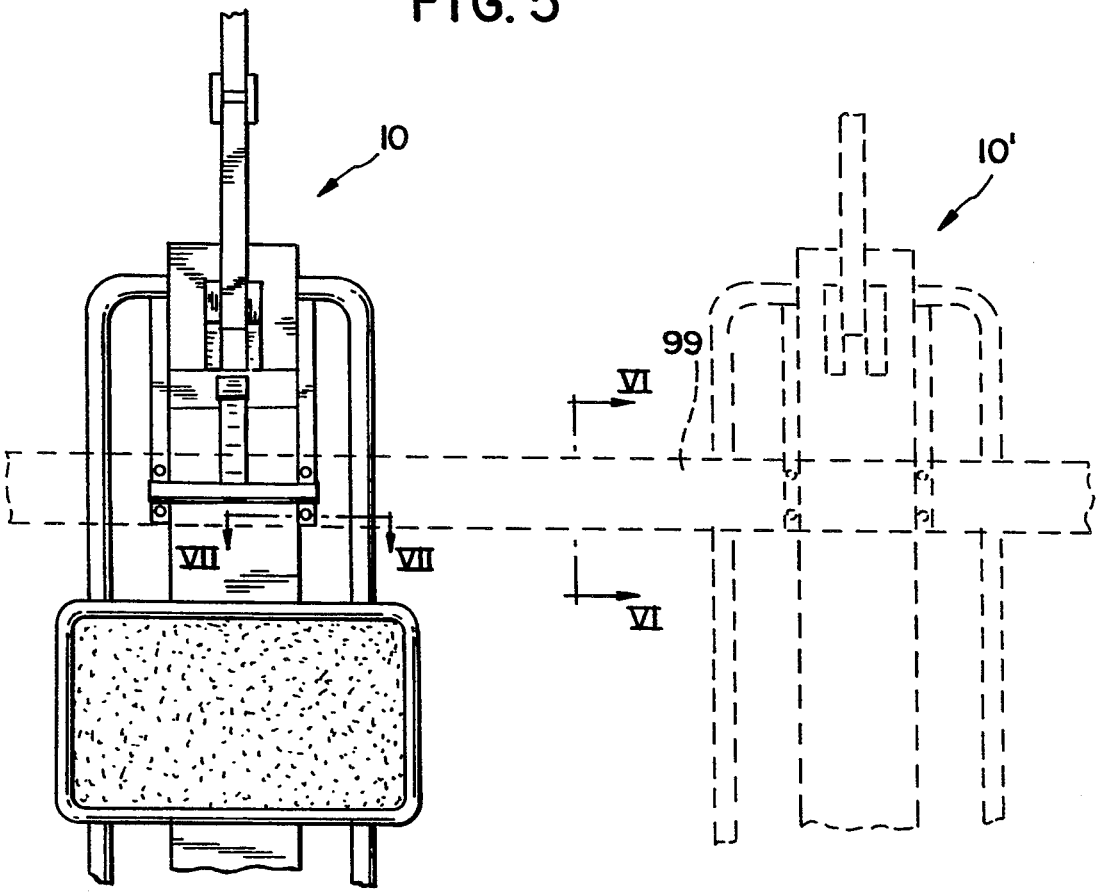
FIG. 5 shows a top view of the device illustrated in FIGS. 1 and 2 with an additional adjacent such device and interconnecting bracket shown in phantom.
Figure 6:
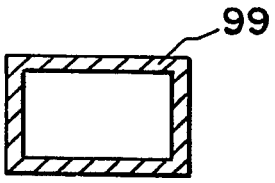
FIG. 6 shows a cross-sectional view along the line VI—VI of FIG. 5.
Figure 7:
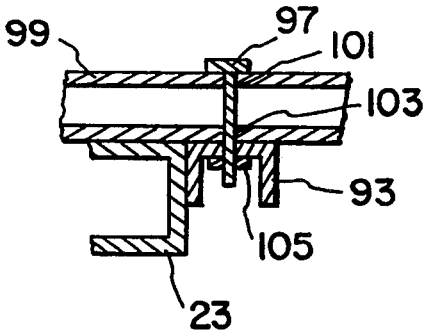
FIG. 7 shows a cross-sectional view along the line VII—VII of FIG. 5.
Figure 8:
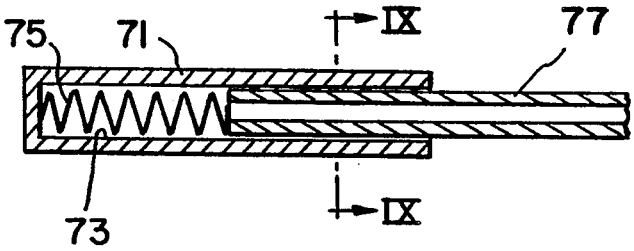
FIG. 8 shows a cross-sectional view through an elongated arm and associated receptacle of the present invention.
Figure 9:
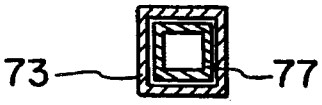
FIG. 9 shows a cross-sectional view along the line IX—IX of FIG. 8.

The first arm 61 forms the base of a T-shaped structure with the cross member 71 comprising second attachment means having a receptacle 73 which, as best seen in FIG. 8, includes an internal chamber receiving baising means comprising, for example, a compression spring 75 which slidably receives an elongated arm 77 the end of which is seen in FIG. 4. At the end of the arm 77 distal from the receptacle 71, a plate 79 is provided having two holes 81, 83 therethrough. A further elongated plate 85 has four holes 87 therethrough with any two of the holes 87 being alignable with the holes 81, 83 to permit bolts 82 to be placed through the aligned holes and to be fastened by virtue of the nuts 84 shown in phantom in FIG. 4. A generally oval-shaped tubular member 89 is suitably welded to the plate 85 and is sized to be removably received within the pad 90 as shown, in particular, in FIG. 1. In order to prevent relative rotation between the pad 90 and the base 11, as best seen in FIG. 9, the elongated arm 77 and the configuration of the receptacle 73 chamber comprise generally rectangular or square cross-sections. With reference to FIGS. 1, 2, 5, 6 and 7, it is seen that the member 23 has suitably attached thereto two opposed brackets 93 and 95 each one of which has two openings closely spaced from one another and sized to receive fastening bolts 97. The brackets 93, 95 are provided in the event it is desired to couple together a plurality or multiplicity of sleds 10 together so that a plurality of players may simultaneously practice together. With particular reference to FIG. 5, it is seen that an elongated connecting bracket 99 may suitably couple adjacent sleds 10 and 10' (shown in phantom) by providing the bracket 99 with holes 101, 103 (FIG. 7) which are aligned and suitably receive therethrough the bolt 97 and may be fastened under a bracket, in the example shown in FIG. 7, the bracket 93 through the use of a nut 105. Through the use of four bolt-nut combinations, as should be understood from viewing of FIGS. 1, 5 and 7, in particular, a plurality or multiplicity of adjacent sleds 10, 10' may be suitably fastened together using a single elongated bracket 99 having the narrow profile best seen in FIG. 6. In this way, if a coach desires his players to run between adjacent pads 90, for whatever purpose, it will be less likely that a player will be injured performing such an exercise than would be the case were a plurality of adjacent parallel brackets 99 employed as is the case with all prior art known to Applicant.

In the operation of a single sled, for example, the sled 10, in accordance with the teachings of the present invention, as should be understood from the above description, a player will run up to the pad 90 and will strike the pad 90 in a generally horizontal direction. Such movement, with sufficient force, will cause reciprocation of the elongated arm 77 within the receptacle 73 chamber of the cross member 71 thereby compressing the spring 75. During reciprocatory movements of the elongated arm 77, the player may simultaneously lift up on the pad 90 thereby causing pivoting movements of the arms 49, 51 within the limits defined by use, for example, of the pin 47 either below the arm 51, above the arm 51 or in both positions through the use of plural pins 47. When the simultaneous reciprocatory and pivoting movements of the pad 90 have resulted in achieving of the limit of compression of the spring 75 and a limit in upward pivoting of the arms 49 and 51, further force applied to the pad 90 will result in forward movement of the entire sled assembly 10 itself without lifting of the base 11 thereof off the ground. Through use of the inventive sled 10, a player may accurately simulate actual blocking conditions in a way nowhere contemplated in the prior art.

Through the use of the bracket 99, a plurality or multiplicity of sleds, such as the sled 10, with or without the handle 27, 29 and platform 31 may be coupled together to allow a plurality of players to simultaneously practice or to coordinate movements of an entire offensive line together.

As such, an invention has been disclosed in terms of preferred embodiments thereof which fulfill each and every one of the objects of the present invention as set forth hereinabove and provide a new and useful dual motion blocking sled of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A blocking sled, comprising:

a) a base having runner means for guiding said sled over a ground surface;

b) first attachment means on said base for pivotably attaching a first arm thereto at a first end of said first arm;

c) said first arm having a second end carrying second attachment means for reciprocably carrying a second arm, said second arm having a first end engaging said second attachment means and a second end remote therefrom, said second attachment means comprising a cross member having a receptacle reciprocably receiving said second arm, said second attachment means further comprising biasing means for biasing said second arm in a direction away from said receptacle;

d) said second end of said second arm having, attached thereto, a vertically adjustable bracket removably receivable within a pad;

e) whereby said pad may be engaged and simultaneously reciprocated and pivoted while said runner means remains firmly on said ground surface.

2. The invention of claim 1, wherein said runner means comprises a pair of parallel runners.

3. The invention of claim 1, wherein said first attachment means includes a pair of parallel plates pivotably supporting said first arm therebetween.

4. The invention of claim 3, wherein said first attachment means includes a plurality of parallel arms.

5. The invention of claim 4, further including a limit stop adjustable between said plates to limit upper and lower extent of pivoting of said parallel arms and thereby said first arm.

6. The invention of claim 1, wherein said receptacle includes a chamber receiving a compression spring engaging said first end of said second arm.

7. The invention of claim 1, wherein said vertically adjustable bracket includes a plate with a generally oval-shaped member attached thereto and removably receivable within said pad.

8. The invention of claim 7, wherein said bracket plate includes at least three holes and a further plate on said second end of said second arm has two holes, any two adjacent ones of said bracket plate three holes being alignable with said further plate two holes and fasteners for fastening said bracket plate and further plate together via aligned pairs of said holes.

9. The invention of claim 1, wherein a plurality of blocking sleds are coupled together with a single elongated bracket.

* * * * *